US011847983B2

(12) United States Patent
Chen et al.

(10) Patent No.: US 11,847,983 B2
(45) Date of Patent: Dec. 19, 2023

(54) IMAGE DISPLAY DEVICE AND CONTROL METHOD THEREOF

(71) Applicant: Qisda Corporation, Taoyuan (TW)

(72) Inventors: Min-Jye Chen, Taoyuan (TW); Kuang-Hung Chien, Taoyuan (TW); Chia-Lin Chen, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/826,282

(22) Filed: May 27, 2022

(65) Prior Publication Data

US 2023/0148216 A1 May 11, 2023

(30) Foreign Application Priority Data

Nov. 11, 2021 (CN) ..... 202111331873.7

(51) Int. Cl.
*G09G 3/34* (2006.01)

(52) U.S. Cl.
CPC ... *G09G 3/3413* (2013.01); *G09G 2310/0237* (2013.01); *G09G 2310/08* (2013.01); *G09G 2320/0626* (2013.01)

(58) Field of Classification Search
CPC ... G09G 2320/0247; G09G 2320/0238; G09G 2320/0209; G09G 2320/0233; G09G 2320/043; G09G 2320/0271; G09G 2320/045; G09G 2330/021; G09G 2330/025; G09G 3/3233; G09G 3/003; G09G 2300/0861
See application file for complete search history.

(56) References Cited

U.S. PATENT DOCUMENTS

2005/0254509 A1* 11/2005 Smith ..... G06T 3/40 370/429
2006/0208998 A1* 9/2006 Okishiro ..... G09G 3/3406 345/102
2010/0149435 A1* 6/2010 Kataoka ..... G03B 33/12 348/790
2012/0256908 A1* 10/2012 Lee ..... H04N 13/341 345/419
2016/0269697 A1* 9/2016 Narikawa ..... H04N 9/3164

* cited by examiner

*Primary Examiner* — Dong Hui Liang

(57) ABSTRACT

An image display device is provided. The image display device includes a display unit and a backlight module. The display unit is used for displaying pictures in an image frame cycle. The backlight module includes a plurality of light sources of different colors. The image frame cycle is divided into a first interval, a second interval and a third interval in sequence, and the second interval is adjacent to the first interval. The backlight module provides a white light source with a first intensity in the first interval and provides a white light source with a second intensity in the second interval, and the second intensity is smaller than the first intensity. The backlight module is turned off in the third interval.

12 Claims, 10 Drawing Sheets

IMAGE DISPLAY DEVICE AND CONTROL METHOD THEREOF

This application claims the benefit of People's Republic of China application Serial No. 202111331873.7, filed Nov. 11, 2021, the subject matter of which is incorporated herein by reference.

TECHNICAL FIELD

The present disclosure relates to an electronic device and a control method thereof, and more particularly, relates to an image display device and a control method for suppressing backlight afterimages.

BACKGROUND

Due to the characteristic of visual persistence of human visual perception, when the image frame of the display is updated, afterimage of previous image frame may interfere with visual perception of the current image frame, resulting in dragging of picture of display and causing motion blur.

In order to improve the phenomenon of motion blur, the display may support a mechanism of "moving picture response time (MPRT)" to insert a black image frame between normal image frames, referred to as an operation of "black frame insertion (BFI)". Alternatively, the backlight module may be turned off between intervals of displaying normal image frames, so as to simulate the operation of black frame insertion.

When simulating the operation of black frame insertion, although the backlight module has been turned off and stops providing backlight, however, due to characteristic of visual persistence, the backlight before the backlight module is turned off may still cause afterimages. The red afterimage of red light source has the longest duration length and interferes with visual perception seriously. Traditionally, color gamut range of phosphor powder of backlight sources with various colors is reduced, so as to change spectral components of red light source to reduce the red afterimage.

However, in order to change color gamut range of phosphor powder of backlight sources, hardware of the backlight module must be changed, which will consume more hardware costs. To address the aforementioned technical problems, skilled ones of related industries in the technical field of display are devoted to develop a more effective method, so that operation of black frame insertion may be simulated under MPRT, and red afterimages may be reduced.

SUMMARY

The present disclosure provides an image display device and an operation method thereof, which are used to control the backlight module of an image display device to provide backlights with different intensities in different intervals of an image frame cycle, so that afterimage of the image display device may be reduced.

According to an aspect of the present disclosure, an image display device is provided. The image display device includes a display unit and a backlight module. The display unit is used for displaying pictures in an image frame cycle. The backlight module includes a plurality of light sources of different colors. The image frame cycle is divided into a first interval, a second interval and a third interval in sequence, the second interval is adjacent to the first interval, the backlight module provides a white light source with a first intensity in the first interval and provides a white light source with a second intensity in the second interval, the second intensity is smaller than the first intensity, and the backlight module is turned off in the third interval.

According to another aspect of the present disclosure, an image display device is provided. The image display device includes a display unit and a backlight module. The display unit is used for displaying pictures in an image frame cycle, and the image frame cycle has a first interval and a third interval. The backlight module includes a plurality of light sources of different colors, the backlight module is used for providing a white light source with a first intensity to the display unit in the first interval, and the backlight module is turned off in the third interval. The image frame cycle further includes a second interval and a fourth interval, the second interval and the fourth interval are between the first interval and the third interval, the second interval is adjacent to the first interval and the fourth interval is adjacent to the second interval, the backlight module provides a white light source with a second intensity in the second interval, the second intensity is smaller than the first intensity, and the backlight module provides a white light source with a third intensity in the fourth interval, the third intensity is smaller than the second intensity.

According to still another aspect of the present disclosure, a control method of an image display device is provided. The control method includes the following steps. Dividing an image frame cycle of a display unit into a first interval, a second interval and a third interval in sequence, wherein the second interval is adjacent to the first interval. In the first interval, a backlight module is controlled to provide a white light source with a first intensity to the display unit. In the second interval, the backlight module is controlled to provide a white light source with a second intensity to the display unit, wherein the second intensity is smaller than the first intensity. In the third interval, the backlight module is turned off.

Figure 1:
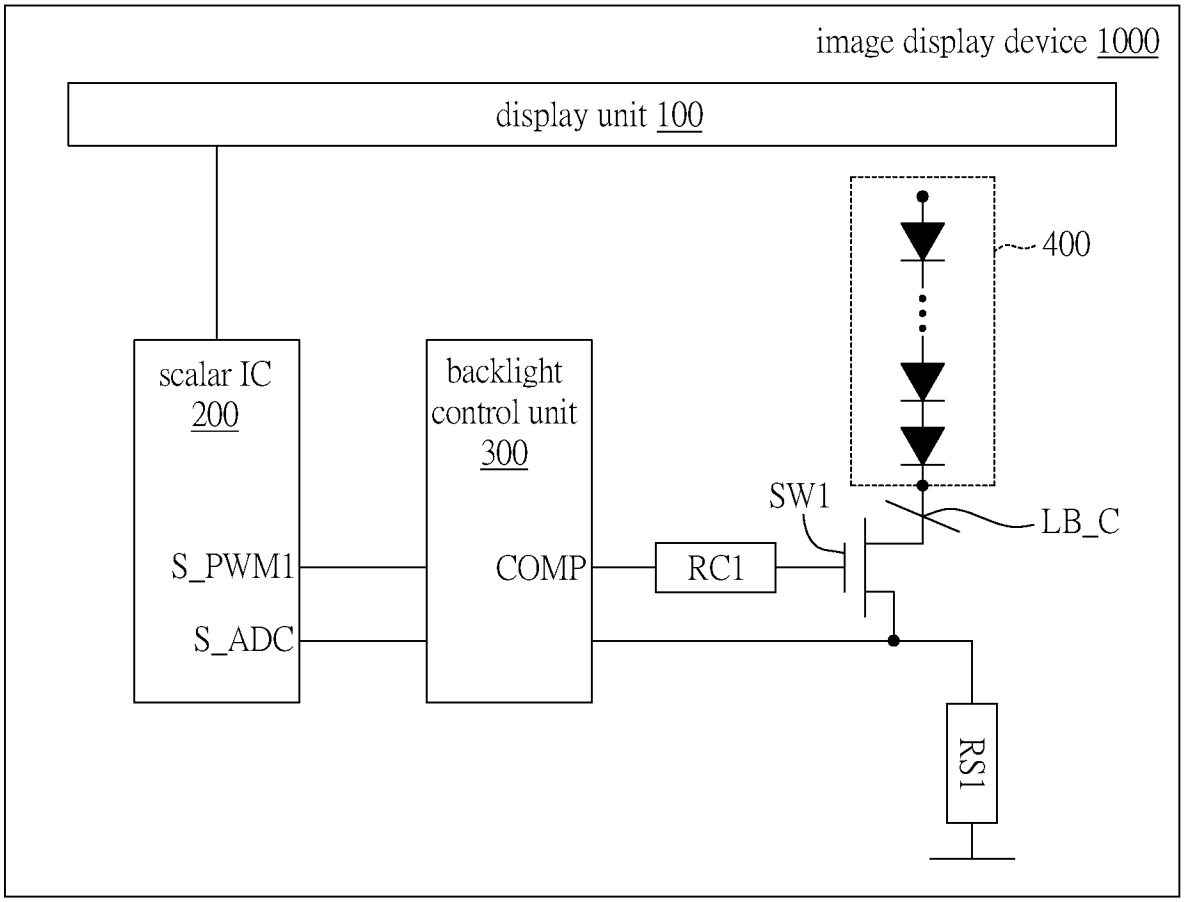
FIG. 1 is a block diagram of an image display device according to an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically illustrated in order to simplify the drawing.

DETAILED DESCRIPTION

FIG. 1 is a block diagram of an image display device 1000 according to an embodiment of the present disclosure. Referring to FIG. 1, the image display device 1000 includes a display unit 100, a scalar IC 200, a backlight control unit 300 and a backlight module 400. The image display device 1000 is, for example, an external screen of a desktop computer or a built-in screen of a laptop computer, and may also be a display screen of a home TV or a display screen of a video wall of a commercial exhibition hall. The display unit 100 is a display panel of the image display device 1000. The display unit 100 has a plurality of pixels, and these pixels may form a whole picture.

Figure 2:
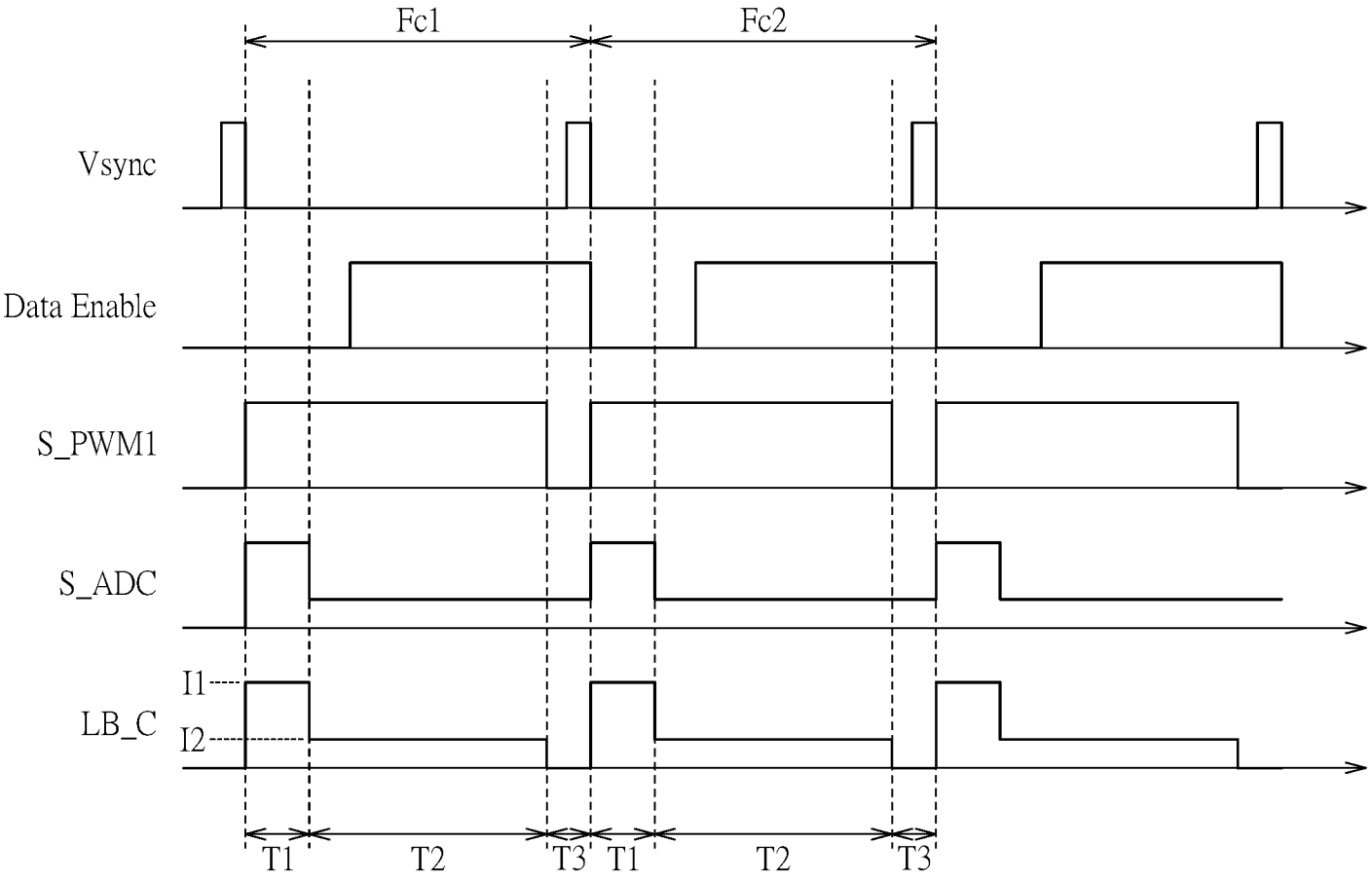
FIG. 2 is a timing diagram of each control signal of the image display device according to an embodiment of the present disclosure.
Figure 3A:
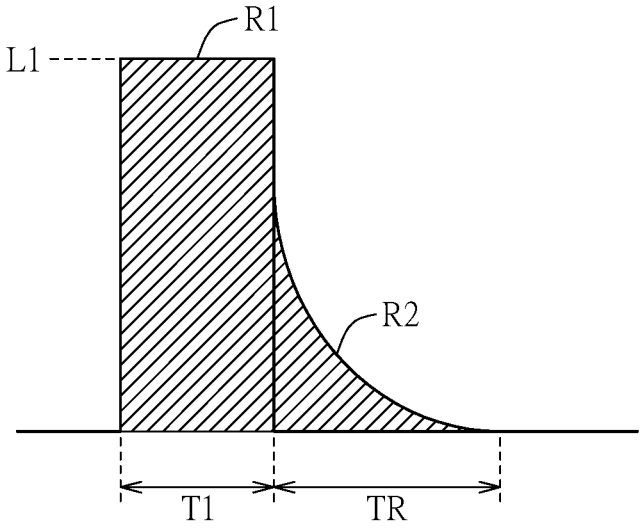
FIGS. 3A-3D are schematic diagrams of afterimages of the backlight module.
Figure 3B:
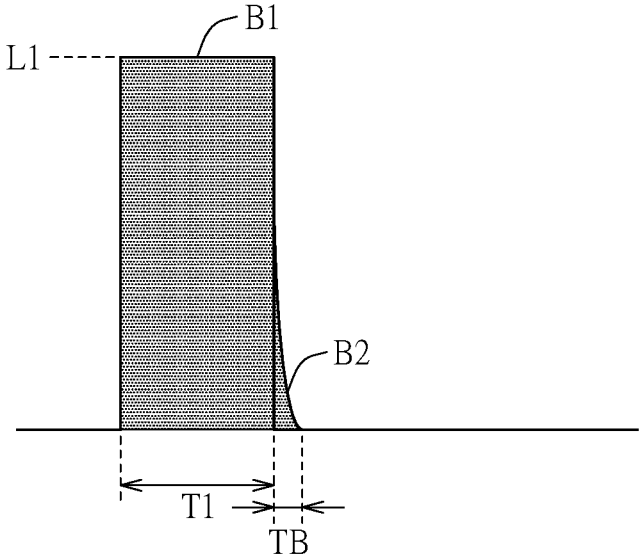
Figure 3C:
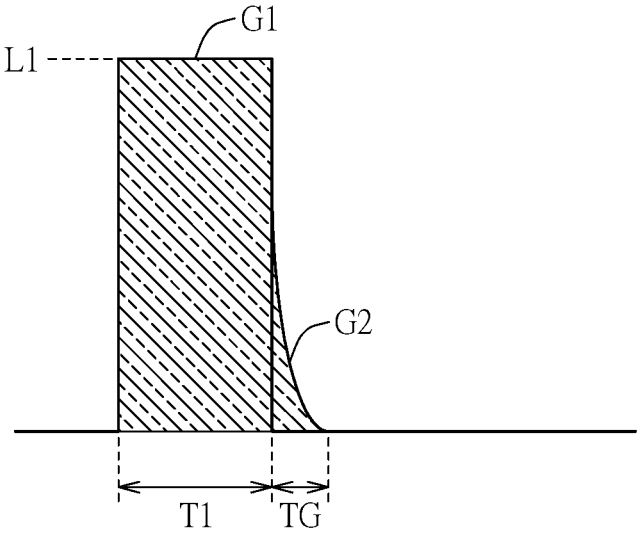
Figure 3D:
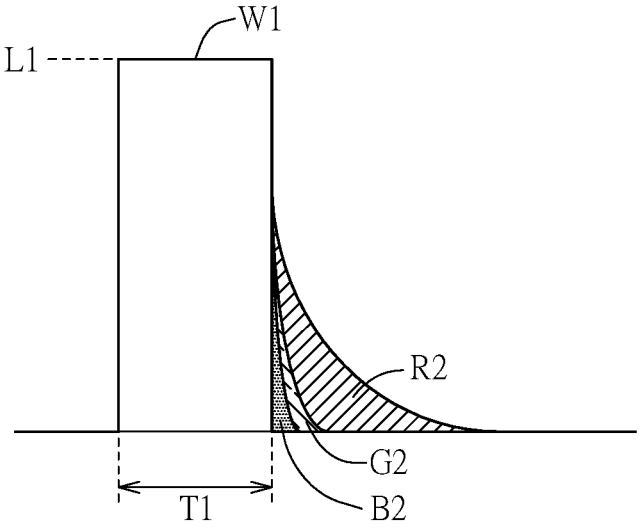

Please also refer to FIG. 2, which is a timing diagram of each control signal of the image display device 1000 according to an embodiment of the present disclosure. In operation, the display unit 100 defines an image frame cycle according to a vertical synchronization signal Vsync and updates the image frame according to the vertical synchronization signal Vsync. Accordingly, the display unit 100 displays a picture of the corresponding image frame in each image frame cycle. For example, the picture of the first image frame is displayed in the first image frame cycle Fc1, and the picture of the second image frame is displayed in the second image frame cycle Fc2, and so on. In one example, the display updating frequency of the display unit 100 is 80 fps, i.e., 80 image frames are displayed per second. In other words, the duration length of each image frame cycle is 1/80 second (i.e., 0.0125 seconds). In the operating schemes of the display unit 100, each image frame cycle may be further divided into at least a first interval T1, a second interval T2 and a third interval T3 in sequence. The display unit 100 may display a normal picture including video content in the first interval T1.

Please refer to FIG. 1 again, the backlight module 400 is, for example, a backlight plate of the image display device 1000. The backlight module 400 may dispose a plurality of light emitting diodes (LED) or micro light emitting diodes (micro LED) to form a plurality of light sources (i.e., backlight sources), thereby providing the backlight of the image display device 1000. Moreover, these light sources have different colors, such as red light sources, blue light sources and green light sources. The red light sources, blue light sources and green light sources may be mixed as white light sources. In the operating scheme of the backlight module 400, as shown in FIG. 2, when the display unit 100 displays a normal picture in the first interval T1, the backlight module 400 correspondingly provides a white light source in the first interval T1. That is, the backlight module 400 entirely turns on the red light source, blue light source and green light source, and the three types of light sources are mixed as the white light source.

On the other hand, the scalar IC 200 and the backlight control unit 300 may provide a plurality of control signals or driving signals to control the operation of the backlight module 400. In this embodiment, the scalar IC 200 may provide a first control signal S_PWM1 and a second control signal S_ADC to the backlight control unit 300, and the backlight control unit 300 may correspondingly generate a third control signal COMP. The third control signal COMP may be further converted to a first driving signal LB_C through the circuit element RC1 and the transistor SW1, and the first driving signal LB_C is used to drive the backlight module 400. As shown in FIG. 2, in the first interval T1, the first control signal S_PWM1 and the second control signal S_ADC are both in an enable state (e.g., a state of high voltage level). Correspondingly, the third control signal COMP is also in the enable state (not shown in FIG. 2). Accordingly, the first driving signal LB_C of the enable state may be provided to drive the backlight module 400. In this embodiment, the first driving signal LB_C is a driving current, and the backlight module 400 may adjust the intensity of the light sources according to the current value of the first driving signal LB_C. For example, the current value I1 of the first driving signal LB_C generates a white light source with a first intensity L1.

However, the white light source may have an afterimage after the first interval T1, as shown in the schematic diagrams of the afterimages of the backlight module 400 in FIGS. 3A-3D. The white light source W1 in the first interval T1 has a red light component R1, a blue light component B1 and a green light component G1. The red light component R1 has a red afterimage R2 after the first interval T1, and the duration length of the red afterimage R2 is TR. Furthermore, the blue light component B1 has a blue afterimage B2 with a duration length of TB. Moreover, the green light component G1 has a green afterimage G2 with a duration length of TG. More particularly, the red light sources, blue light sources and green light sources of the backlight module 400 may be realized by, for example, red light diodes, blue light diodes and green light diodes. The above-mentioned colorful diodes use phosphor powders of different colors. Different colors of phosphor powders have different response times in human visual perception, wherein the response time of red phosphor powders is the longest. Therefore, the red afterimage R2 of the red light component R1 has the longest duration length TR (i.e., the duration length TR of the red afterimage R2 is greater than the duration length TG of the green afterimage G2 and the duration length TB of the blue afterimage B2). Therefore, for human visual perception, the red afterimage R2 is the most significant, which is referred to as "red afterimage phenomenon". The technical solution of the present disclosure refers to control backlight of the backlight module 400 by software or firmware so as to suppress or eliminate the above-mentioned red afterimage phenomenon.

Figure 4:
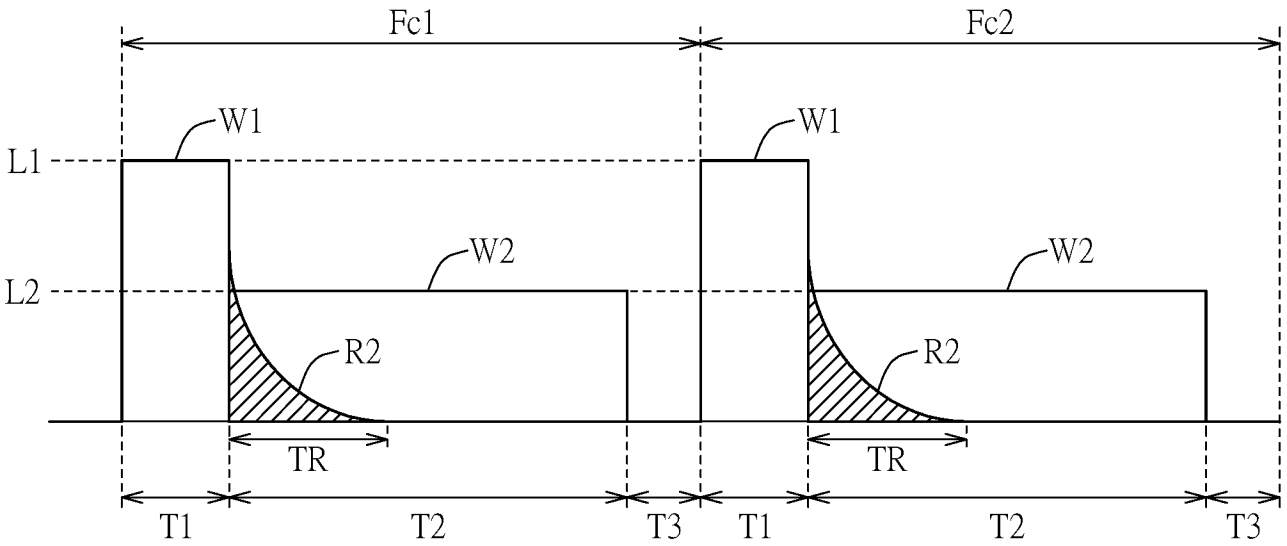
FIG. 4 is a timing diagram illustrating backlight control of the backlight module according to an embodiment of the present disclosure.

Please refer to FIG. 4, which shows a timing diagram of backlight control of the backlight module 400 according to an embodiment of the present disclosure. In the backlight control mechanism of the present embodiment, the backlight module 400 is controlled to continuously provide a white light source after the first interval T1 to shield or cover the red afterimage R2. Specifically, in the second interval T2 adjacent to the first interval T1 (the second interval T2 is after the first interval T1), the backlight module 400 may provide a white light source W2 with the second intensity L2 (that is, the duration length of the white light source W2 is equal to the duration length of the second interval T2) so as to shield or cover the red afterimage R2. Compared with the white light source W1 in the first interval T1, the second intensity L2 of the white light source W2 in the second interval T2 is smaller (i.e., the second intensity L2 is smaller than the first intensity L1). Moreover, the duration length of the white light source W2 (i.e., the duration length of the second interval T2) is at least greater than the duration length TR of the red afterimage R2. Therefore, for human visual perception, the white light source W2 may effectively shield or cover the red afterimage R2 and eliminate the red afterimage phenomenon.

Next, a "Moving Picture Response Time (MPRT)" mode of the display is supported, and the backlight module 400 is turned off in the third interval T3 (which is after the second interval T2 and adjacent to the second interval T2) to simulate an operation of black frame insertion, thereby suppressing motion blur of the display unit 100.

The above-described embodiments may be applied to each image frame cycle. For example, in the second interval T2 of the first image frame cycle Fc1, the backlight module 400 provides a white light source W2 with a second intensity L2 to cover the red afterimage R2. Based on the same implementation, the white light source W2 of the second intensity L2 is also provided in the second interval T2 of the second image frame cycle Fc2, and so on. Referring to FIG. 2 again, in order to control and drive the backlight module 400 to provide white light sources with a first intensity L1 and a second intensity L2 in the first interval T1 and the second interval T2 respectively, the second control signal S_ADC of the scalar IC 200 in the second interval T2 has a voltage level lower than the voltage level in the first interval T1, so that the current value I2 of the first driving signal LB_C of the backlight control unit 300 in the second interval T2 is smaller than the current value I1 in the first interval T1. Furthermore, the current value of the first driving signal LB_C is substantially reduced to zero in the third interval T3, so as to turn off the backlight module 400.

Figure 5:
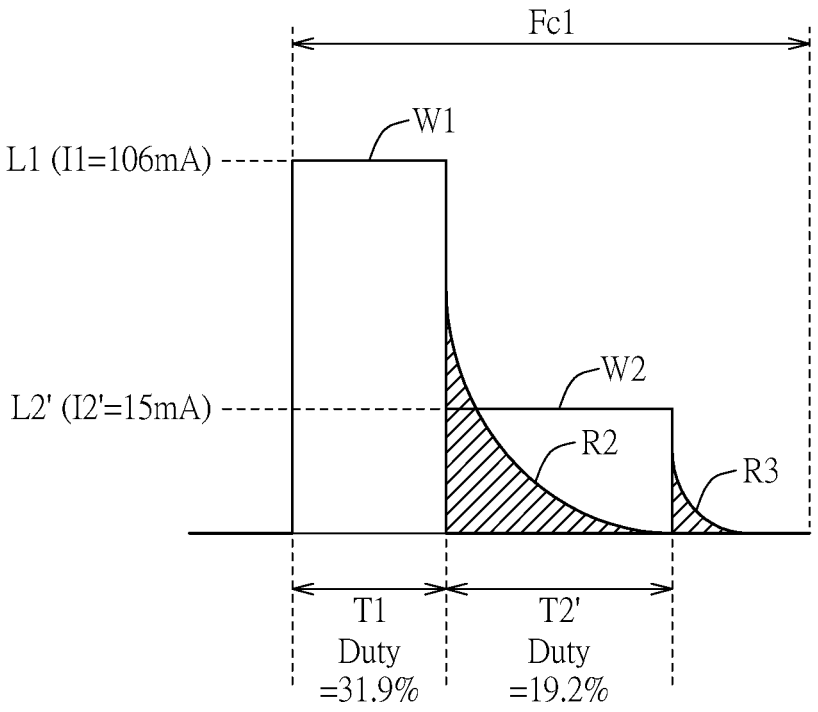
FIG. 5 is a timing diagram illustrating backlight control of the backlight module according to another embodiment of the present disclosure.

FIG. 5 is a timing diagram illustrating backlight control of the backlight module 400 according to another embodiment of the present disclosure (only one image frame cycle Fc1 is shown). Referring to FIG. 5, the second intensity L2' of the white light source W2 in this embodiment may be smaller than the second intensity L2 of the white light source W2 in FIG. 4. In addition, the duration length of the white light source W2 in this embodiment (i.e., the duration length of the second interval T2') may be smaller than the duration length of the white light source W2 of FIG. 4 (i.e., the duration length of the second interval T2). That is, in this embodiment, the intensity and duration length of the white light source W2 are reduced, so that the white light source W2 has a smaller profile, but can still cover the red afterimage R2.

For example, in the first interval T1, the current value I1 of the first driving signal LB_C for generating the white light source W1 is 106 mA, so that the white light source W1 has the first intensity L1. The ratio of duration length of the white light source W1 (i.e., duration length of the first interval T1) to the entire image frame cycle Fc1 is 31.9%. Correspondingly, in the second interval T2', the current value I2' of the first driving signal LB_C is set as 15 mA, so that the white light source W2 has the first intensity L2'. The ratio of duration length of the white light source W2 (i.e., duration length of the second interval T2') is set as 19.2%. Under the above-mentioned settings for intensity and duration length, the white light source W2 in the second interval T2' can still substantially cover the red afterimage R2.

In this embodiment, even though the white light source W2 in the second time interval T2' still has a red afterimage R3, the intensity of the white light source W2 has been reduced to a smaller value of second intensity L2'. The red afterimage R3 generated by the white light source W2 has reduced intensity and duration length, hence human visual perception is less affected.

Figure 6A:
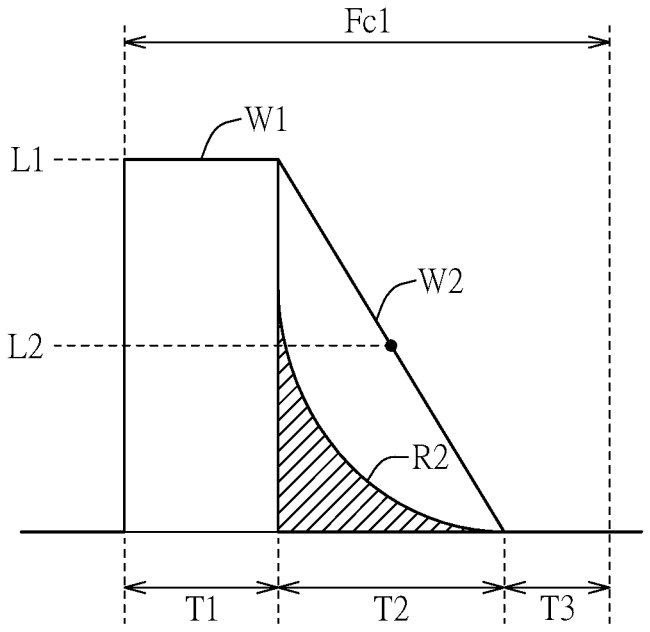
FIGS. 6A-6C are timing diagrams illustrating backlight control of the backlight module according to another three embodiments of the present disclosure.
Figure 6B:
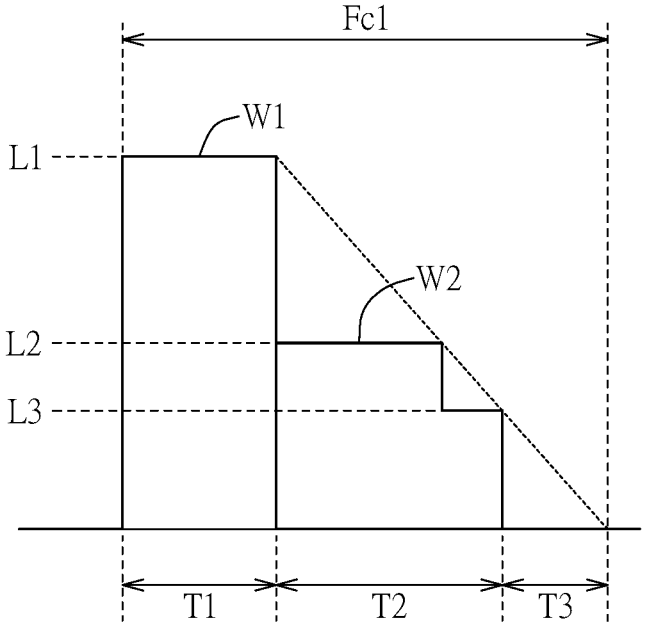
Figure 6C:
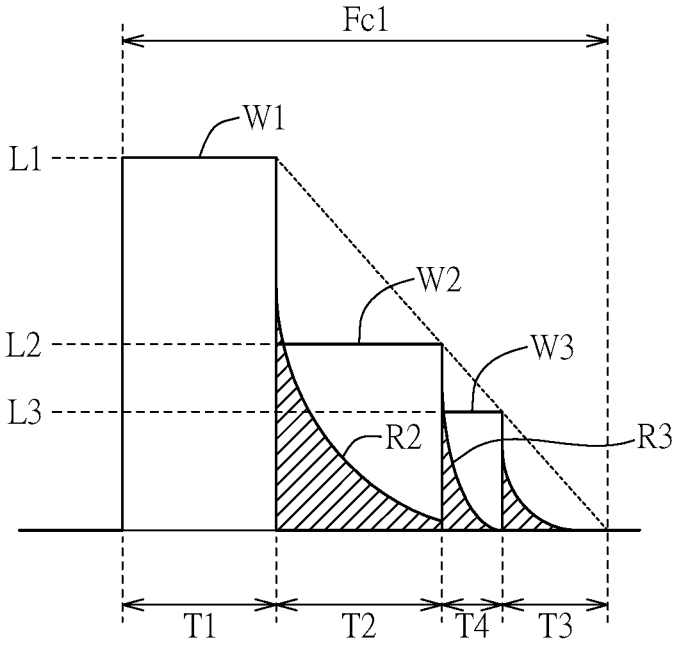

As described above, in the embodiments shown in FIGS. 4 and 5, after the first interval T1 the backlight module 400 provides white light source with constant intensity, for example, the intensity of the white light source W2 is a constant value of second intensity L2 (or second intensity L2'). On the other hand, since the intensity of the red afterimage R2, the blue afterimage B2 and the green afterimage G2 is gradually decreasing, the red afterimage can be substantially covered by providing white light source W2 with decreasing intensity. FIGS. 6A-6C are timing diagrams illustrating backlight control of the backlight module 400 according to another three embodiments of the present disclosure. First, please refer to FIG. 6A, the second intensity L2 of the white light source W2 may gradually decrease in the second interval T2. For example, the second intensity L2 decreases from the first intensity L1 to zero in a ramp-down manner (i.e., ramped decrease). On the other hand, referring to FIG. 6B, the second intensity L2 of the white light source W2 may decrease to the third intensity L3 in a stepped manner (i.e., stepped decrease) in the second interval T2.

The embodiment of FIG. 6B may also be represented as the aspect of FIG. 6C. As shown in FIG. 6C, the image frame cycle Fc1 may be further divided into a fourth interval T4. The fourth interval T4 is between the second interval T2 and the third interval T3, and the fourth interval T4 is adjacent to the second interval T2. The backlight module 400 provides the white light source W2 during the second interval T2 and provides the white light source W3 during the fourth interval T4. In other words, the embodiment of FIG. 6C further divides the white light source into a white light source W2 and a white light source W3 to cover the red afterimages R2 and R3 respectively. Moreover, the third intensity L3 of the white light source W3 is smaller than the second intensity L2 of the white light source W2. That is, the white light source W2 decreases to the white light source W3 in a stepped manner. Furthermore, the duration length of the white light source W3 (i.e., the duration length of the fourth interval T4) is at least greater than the duration length of the red afterimage R3 after the second interval T2.

Figure 7A:
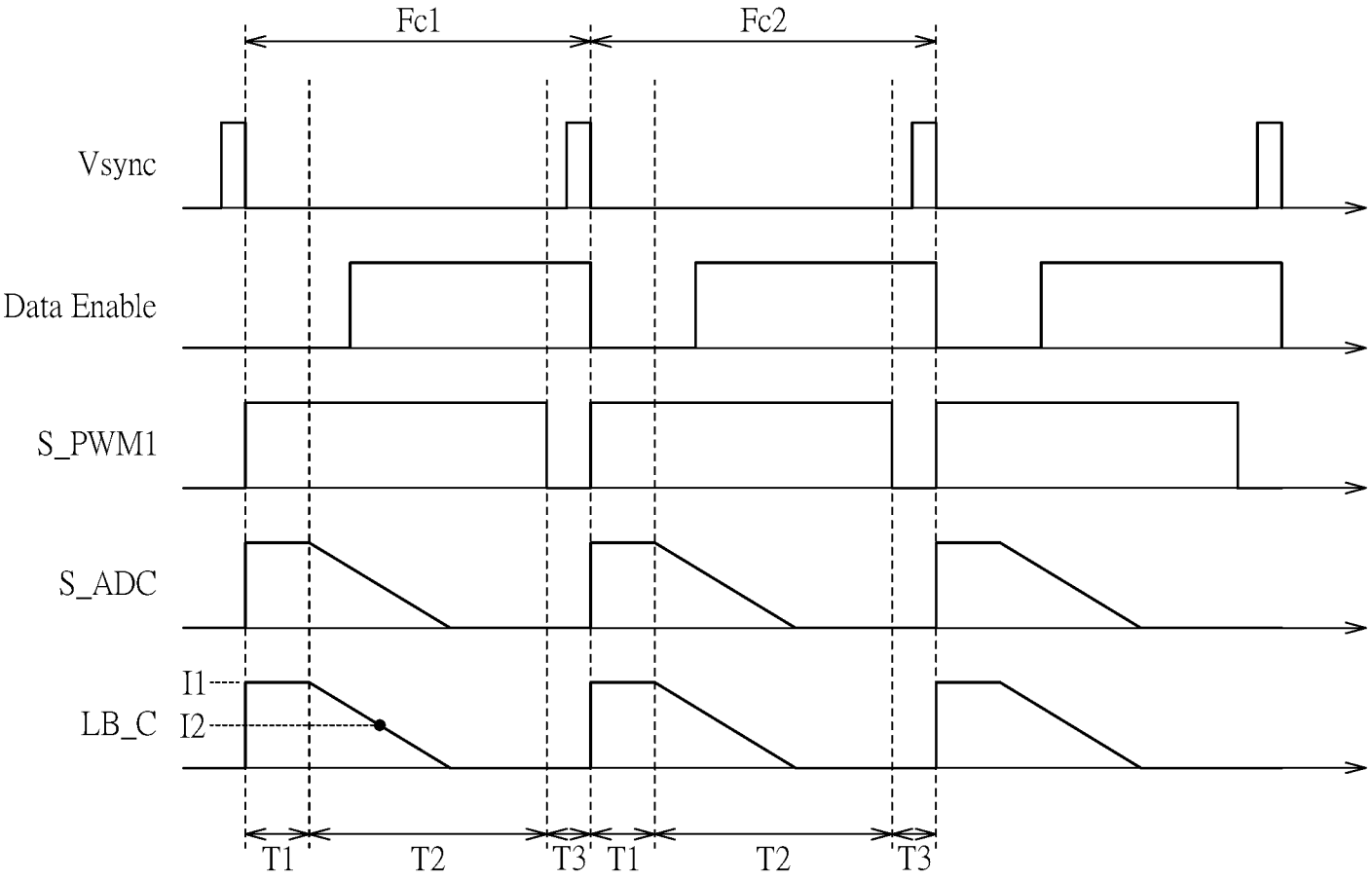
FIGS. 7A and 7B are timing diagrams of each control signal of the image display device corresponding to the embodiments of FIGS. 6A and 6B.
Figure 7B:
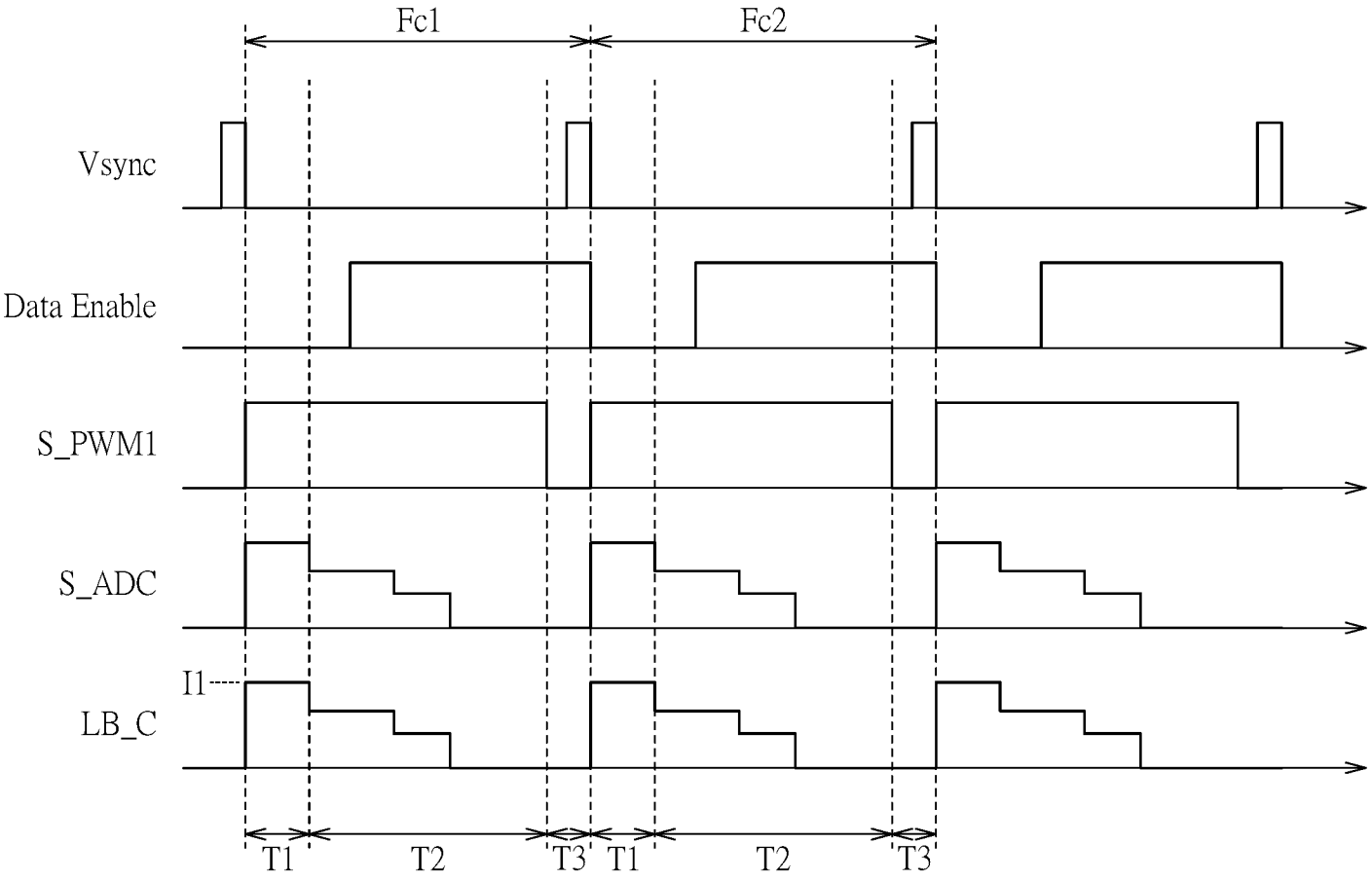

FIGS. 7A and 7B respectively illustrate timing diagrams of each control signal of the image display device 1000 corresponding to the embodiments of FIGS. 6A and 6B. For the backlight module 400 to control the second intensity L2 of the white light source W2 to decrease in a ramp-down manner in the second interval T2 (the embodiment of FIG. 6A), as shown in FIG. 7A, the scalar IC 200 has a second control signal S_ADC with a voltage level ramped decreasing in the second interval T2, and the current value I2 of the first driving signal LB_C of the backlight control unit 300 also ramped decreases in the second interval T2.

On the other hand, for the backlight module 400 to control the second intensity L2 of the white light source W2 to decrease in a stepped manner in the second interval T2 (as the embodiment of FIG. 6B), as shown in FIG. 7B, the voltage level of the second control signal S_ADC of the scalar IC 200 and the current value I2 of the first driving signal LB_C of the backlight control unit 300 also decrease in a stepped manner in the second interval T2.

Figure 8:
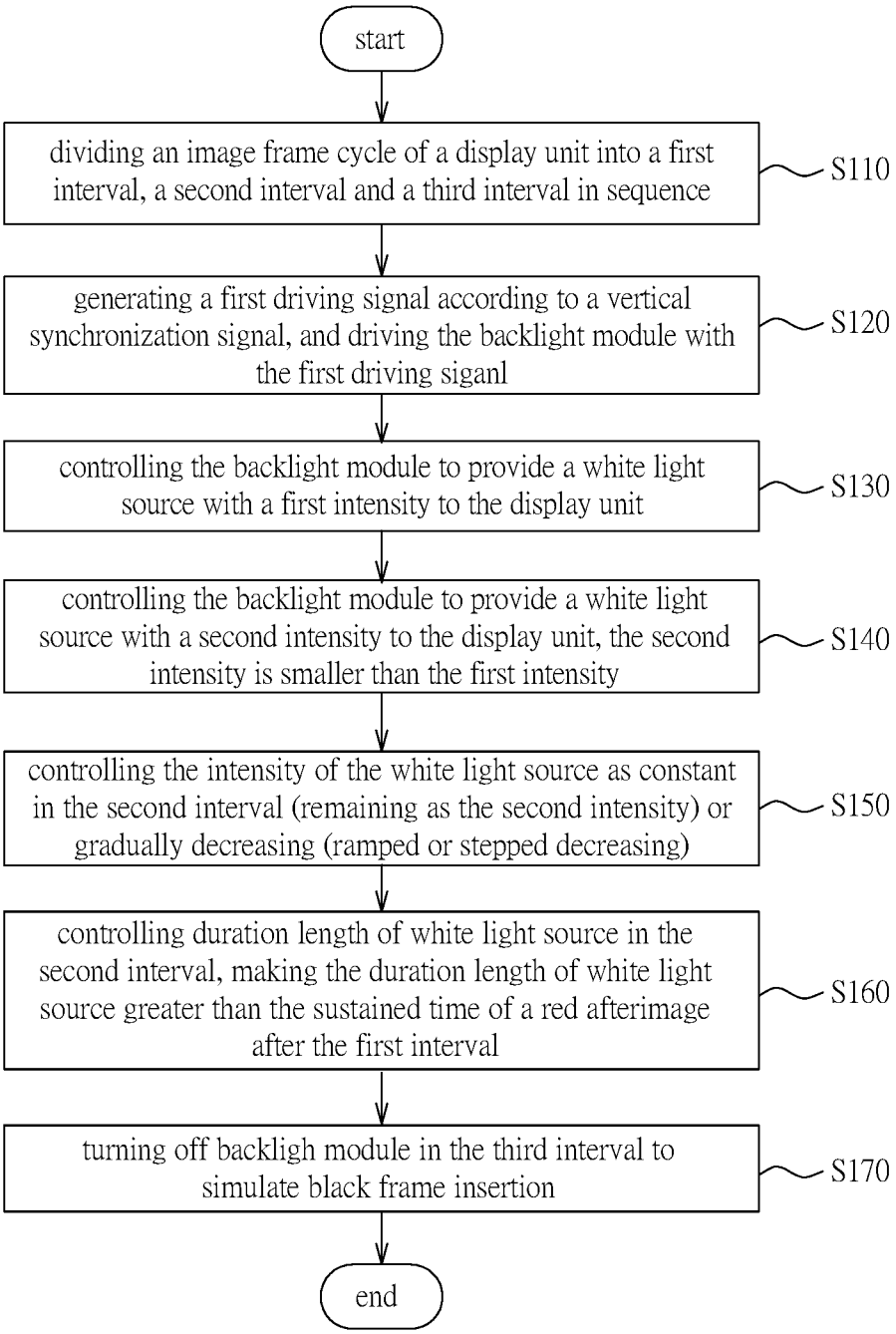
FIG. 8 is a flow diagram of a control method of the image display device according to an embodiment of the present disclosure.

FIG. 8 is a flow diagram of a control method of the image display device 1000 according to an embodiment of the present disclosure. Referring to FIG. 8, in step S110, each image frame cycle of the display unit 100 of the image display device 1000 is sequentially divided into a first interval T1, a second interval T2 and a third interval T3. The second interval T2 is adjacent to the first interval T1. Then, in step S120, the backlight control unit 300 is controlled according to the vertical synchronization signal Vsync of the image display device 1000, so to generate a first driving signal LB_C. The backlight module 400 is driven by the first driving signal LB_C. The intensity of the light source generated by the backlight module 400 may be controlled according to the current value of the first driving signal LB_C, so that the backlight module 400 may provide light sources with different intensities in different intervals of the image frame cycle.

Then, in step S130, the backlight module 400 of the image display device 1000 is controlled to provide the white light source W1, which has a first intensity L1, to the display unit 100 during the first interval T1. Then, in step S140, the backlight module 400 is controlled to provide the white light source W2, which has a second intensity L2, to the display unit 100 in the second interval T2. The second intensity L2 is smaller than the first intensity L1. Then, in step S150, the intensity of the white light source W2 is controlled and adjusted, so that the intensity of the white light source W2 is constant (maintained as the second intensity L2) or decreased in the second interval T2. It may have a ramped type of decreasing or a stepped type of decreasing.

In the examples of the stepped type of decreasing, the image frame cycle may be further divided into a fourth interval T4, which is between the second interval T2 and the third interval T3. In addition, the backlight module 400 is controlled to provide the white light source W3 in the fourth interval T4. The third intensity L3 of the white light source W3 is smaller than the second intensity L2. Accordingly, the white light source W2 provided by the backlight module 400 decreases to form the white light source W3 in a manner of stepped decreasing.

Then, in step S160, duration length of the white light source W2 (i.e., duration length of the second interval T2) is controlled and adjusted to be greater than duration length of the red afterimage R2 of the backlight module 400 after the first interval T1. Accordingly, the white light source W2 with the second intensity L2, which is provided in the second interval T2, can shield or cover the red afterimage R2, after the first interval T1. Hence, the red afterimage phenomenon may be suppressed or eliminated. Then, in step S170, the backlight module 400 is turned off to simulate the operation of black frame insertion.

On the other hand, for the examples where the white light source W2 gradually decreases to form the white light source W3 in a manner of stepped decreasing, duration length of the white light source W3 (i.e., duration length of the fourth interval T4) is also controlled. So that duration length of the white light source W3 is greater than that of the red afterimage R3 of the backlight module 400 after the second interval T2. Hence, the red afterimage R3 is shielded or covered by the white light source W3.

From the above, in the image display device 1000 and the control method thereof according to the embodiments of the present disclosure, between the interval when the image display device 1000 displays a normal picture and the interval when the backlight module is turned off to simulate the operation of black frame insertion, white light sources with different intensities are provided (i.e., the brightness are segmented). Intensity of the white light source is controlled to be constant, ramped decreasing or stepped decreasing, so as to achieve segmented brightness. The white light source is used to cover afterimages of the normal picture, especially covering the red afterimage with the longest duration length, hence technical effect of suppressing or eliminating red afterimage phenomenon is achieved. The technical solution of the present disclosure needs not change the color gamut range of the backlight phosphor powders of the backlight module (i.e., needs not change hardware of the backlight module). Instead, the technical solution of the present disclosure only needs to control the backlight of the backlight module with software or firmware to suppress or eliminate red afterimage phenomenon.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. An image display device, comprising:

a display unit, for displaying pictures in an image frame cycle; and a backlight module, comprising a plurality of light sources of different colors, wherein, the image frame cycle is divided into a first interval, a second interval and a third interval in sequence, the second interval is adjacent to the first interval, the backlight module provides a single white light source with a first intensity in the first interval and provides the single white light source with a second intensity in the second interval, the second intensity is smaller than the first intensity, the duration length of the second interval is greater than the duration length of the sustained time of a red afterimage of the backlight module after the first interval so as to cover the red afterimage and eliminate a red-afterimage-phenomenon, wherein the magnitude of the second intensity gradually decreases in a stepped manner in the second interval, and the second intensity has a predefined ratio less than 0.5 with respect to the first intensity, and the second interval has an adjustable ratio with respect to the first interval, and the backlight module is turned off in the third interval.

2. The image display device according to claim 1, wherein the image frame cycle further includes a fourth interval, the fourth interval is between the second interval and the third interval, the fourth interval is adjacent to the second interval, and the backlight module provides the single white light source with a third intensity in the fourth interval, the third intensity is smaller than the second intensity.

3. The image display device according to claim 2, the duration length of the fourth interval is greater than the duration length of the sustained time of a red afterimage of the backlight module after the second interval.

4. The image display device according to claim 2, further comprising:

a backlight control unit, for generating a first driving signal according to a vertical synchronization signal, and providing the first driving signal to the backlight module, wherein, the vertical synchronization signal updates the image frame cycle, and the backlight module respectively provides the single white light source with the first intensity, the second intensity and the third intensity according to the current value of the first driving signal.

5. The image display device according to claim 1, wherein the magnitude of the second intensity gradually decreases in the second interval.

6. A control method of an image display device, comprising:

dividing an image frame cycle of a display unit into a first interval, a second interval and a third interval in sequence, wherein the second interval is adjacent to the first interval;

in the first interval, controlling a backlight module to provide a single white light source with a first intensity to the display unit;

in the second interval, controlling the backlight module to provide the single white light source with a second intensity to the display unit, wherein the second intensity is smaller than the first intensity;

controlling the duration length of the second interval as being greater than the duration length of the sustained time of a red afterimage of the backlight module after the first interval so as to cover the red afterimage and eliminate a red-afterimage-phenomenon, wherein the magnitude of the second intensity gradually decreases in a stepped manner in the second interval, and the second intensity has a predefined ratio less than 0.5 with respect to the first intensity, and the second interval has an adjustable ratio with respect to the first interval; and in the third interval, turning off the backlight module.

7. The control method according to claim 6, further comprising:

further dividing the image frame cycle into a fourth interval, the fourth interval is between the second interval and the third interval, and the fourth interval is adjacent to the second interval; and in the fourth interval, controlling the backlight module to provide the single white light source with a third intensity to the display unit, wherein the third intensity is smaller than the second intensity.

8. The control method according to claim 7, further comprising:

controlling the duration length of the fourth interval as being greater than the duration length of the sustained time of a red afterimage of the backlight module after the second interval.

9. The control method according to claim 7, further comprising:

controlling a backlight control unit to generate a first driving signal according to a vertical synchronization signal, wherein the vertical synchronization signal updates the image frame cycle;

providing the first driving signal to the backlight module; and controlling the backlight module to respectively provide the single white light source with the first intensity, the second intensity and the third intensity according to the current value of the first driving signal.

10. The control method according to claim 6, further comprising:

controlling the magnitude of the second intensity as gradually decreasing in the second interval.

11. An image display device, comprising:

a display unit, for displaying pictures in an image frame cycle, the image frame cycle having a first interval and a third interval; and a backlight module, comprising a plurality of light sources of different colors, for providing a single white light source with a first intensity to the display unit in the first interval, and the backlight module is turned off in the third interval, wherein, the image frame cycle further includes a second interval and a fourth interval, the second interval and the fourth interval are between the first interval and the third interval, the second interval is adjacent to the first interval and the fourth interval is adjacent to the second interval, the backlight module provides the single white light source with a second intensity in the second interval, the second intensity is smaller than the first intensity, and the duration length of the second interval is greater than the duration length of the sustained time of a red afterimage of the backlight module after the first interval, and the backlight module provides the single white light source with a third intensity in the fourth interval, the third intensity is smaller than the second intensity, and the duration length of the fourth interval is greater than the duration length of the sustained time of a red afterimage of the backlight module after the second interval, so as to cover the red afterimages after the first interval and the second interval and eliminate a red-afterimage-phenomenon, wherein the magnitude of the second intensity gradually decreases in a stepped manner in the second interval, and the second intensity has a predefined ratio less than 0.5 with respect to the first intensity, and the second interval has an adjustable ratio with respect to the first interval.

12. The image display device according to claim 11, further comprising:

a backlight control unit, for providing a first driving signal to the backlight module according to a vertical synchronization signal, wherein, the vertical synchronization signal updates the image frame cycle, and the backlight module respectively provides the single white light source with the first intensity, the second intensity and the third intensity according to the current value of the first driving signal.

* * * * *